US005617960A

United States Patent [19]

Bishop

[11] Patent Number: 5,617,960

[45] Date of Patent: Apr. 8, 1997

[54] APPARATUS FOR HOLDING ROLLED-UP PLANS OR MAPS

[76] Inventor: George Bishop, 300 Morris Rd., Sadieville, Ky. 40370

[21] Appl. No.: 458,560

[22] Filed: Jun. 2, 1995

[51] Int. Cl.[6] ..... A47F 7/00

[52] U.S. Cl. ..... 211/60.1; 211/44; 211/45

[58] Field of Search ..... 211/44, 45, 60.1, 211/70, 74

[56] References Cited

U.S. PATENT DOCUMENTS

| | | | |
|---|---|---|---|
| 196,599 | 10/1877 | Sheldon | 211/70 X |
| D. 348,806 | 7/1994 | Young | D7/702 |
| 663,838 | 12/1900 | White | 211/70 |
| 877,145 | 1/1908 | Waddell . | |
| 1,469,725 | 10/1923 | Helenek . | |
| 1,474,891 | 11/1923 | Burt et al. . | |
| 3,606,023 | 9/1971 | Edmunds | 211/74 |
| 3,870,155 | 3/1975 | Galloway | 211/74 |
| 4,157,626 | 6/1979 | Bedinghaus | 40/518 |
| 5,054,625 | 10/1991 | Foley | 211/60.1 X |
| 5,107,994 | 4/1992 | Karls | 211/45 |

*Primary Examiner*—Robert W. Gibson, Jr.
*Attorney, Agent, or Firm*—Geoffrey A. Mantoot

[57] ABSTRACT

The apparatus has horizontally oriented top, bottom, and middle plates. The top and middle plates have openings therein, which openings receive rolled up plans. Each opening in the top plate is aligned with an opening in the middle plate. The plans, when stored in the apparatus, are vertically oriented so that their bottom ends bear on the solid bottom plate and the top ends extend above the top plate. The bottom plate provides stability to prevent the apparatus from turning over.

8 Claims, 2 Drawing Sheets

APPARATUS FOR HOLDING ROLLED-UP PLANS OR MAPS

FIELD OF THE INVENTION

The present invention relates to apparatuses that hold plans, maps, charts, etc.

BACKGROUND OF THE INVENTION

Architects and businesses frequently deal with building plans. The plans are drawn on paper or plastic and depict floor layouts, elevational views and so on. To provide the necessary detail, these plans are commonly on oversized paper (or plastic).

Storage of such plans is a problem. The paper containing a plan or drawing is rolled up into a tube or cylinder. The paper is then secured by a rubber band so as to prevent the tube from unrolling.

Once the paper is rolled up into a tube, there is no satisfactory place to store the rolled plans. The rolled plans can be laid down onto a surface and stacked in a horizontal orientation. Unfortunately, the rolled plans are cylindrical in shape, wherein the plans tend to roll apart from each other. The rolled plans could be stored on their ends in a vertical orientation. However, the rolled plans must be leaned against something to prevent the plans from falling over.

SUMMARY OF THE INVENTION

Is an object of the present invention to provide an apparatus for holding and storing rolled plans and other rolled print media.

The apparatus holds rolled print media. The print media is rolled into a cylindrical shape. The apparatus includes a bottom plate, a middle plate, and a top plate. The middle plate and the top plate each have plural openings therethrough. Each opening in the top plate is aligned with a respective opening in the middle plate. The bottom plate is solid in locations beneath the openings in the middle plate. The apparatus also has spacers that are located between the bottom plate and the middle plate and between the middle plate and the top plate. The spacers couple the bottom plate to the middle plate in a spaced apart relation and couple the middle plate to the top plate in a spaced apart relation. The rolled print media has two ends and is received by an aligned set of the openings in the middle and top plates, with one of the ends beating on the bottom plate.

In one aspect of the present invention, the bottom is solid so as to prevent the apparatus from tipping over on its side due to the weight of the plans located above the top plate.

In still another aspect of the present invention, the openings are circular in order to constrain the rolled print media and prevent the print media from unrolling.

DESCRIPTION OF THE PREFERRED EMBODIMENT

Figure 1:
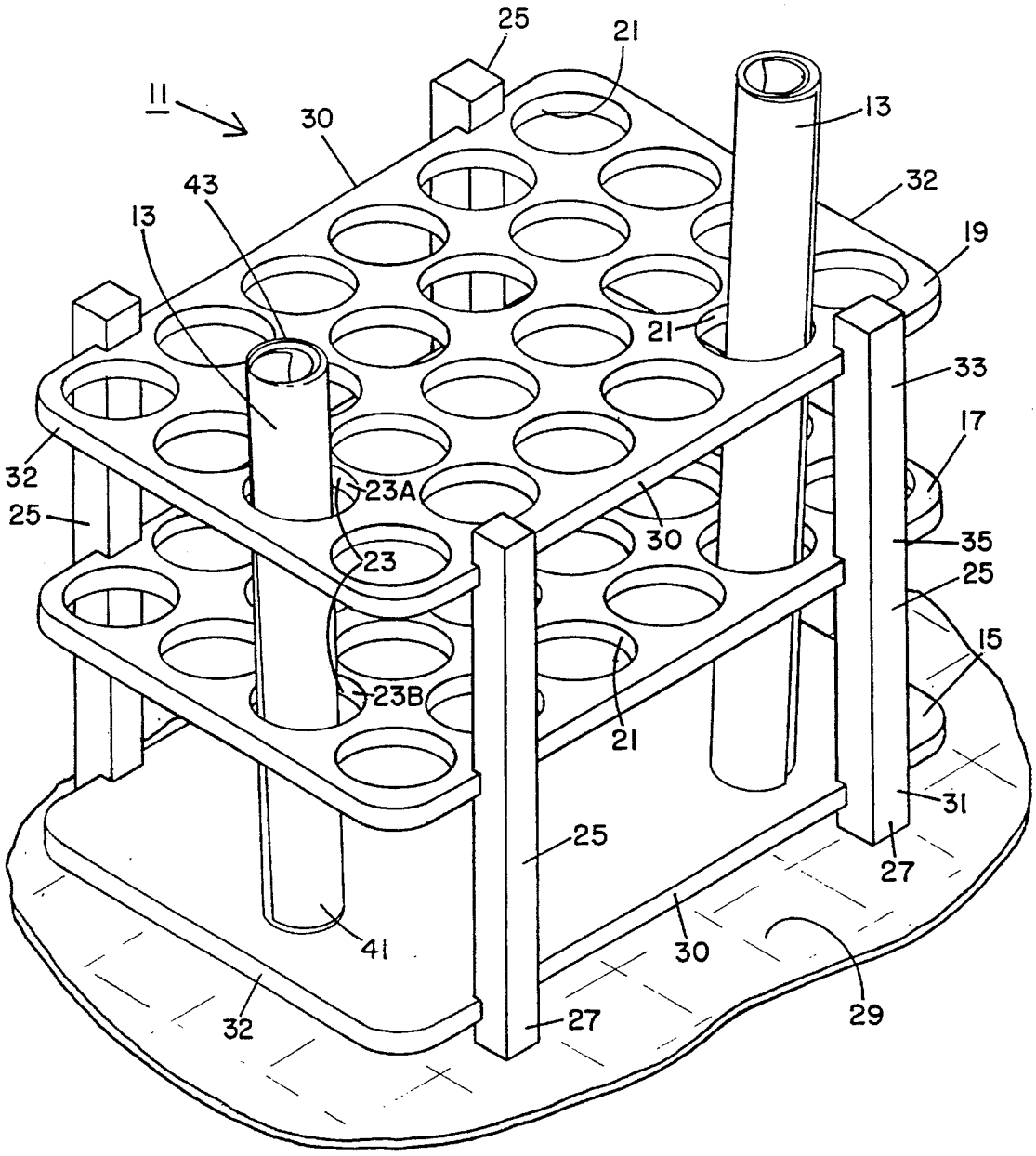
FIG. 1 is an isometric view of the apparatus of the present invention, in accordance with a preferred embodiment.

The apparatus 11 of the present invention is used for holding or storing print media 13 such as rolled paper or plastic. Such rolled paper 13 (or plastic) can contain drawings thereon to depict architectural plans, maps, charts, etc.

The apparatus 11 has a bottom plate 15, a middle plate 17, and a top plate 19. Each plate is of the same size and shape as the other plates. In the preferred embodiment, the plates 15, 17, 19 are rectangular in shape. However, the apparatus can be used as a piece of furniture in a home or office. Thus, the plates can take on a variety of shapes (for example, circular).

The top and middle plates 19, 17 have plural openings 21 therethrough, while the bottom plate 15 is solid directly beneath the openings. Each opening in the top plate 19 is aligned with a particular opening in the middle plate 17 so as to form a set of openings 23. For example, a set of openings includes an opening 23A in the top plate 19. The set of openings also includes an opening 23B in the middle plate, which opening 23B is located directly underneath the top plate opening 23A. The openings can be circular, as shown in FIG. 1, or some other shape. If the openings are circular, then the openings in the top and bottom plate are coaxial.

The bottom, middle, and top plates 15, 17, 19 are spaced apart from each other by spacers 25. In the preferred embodiment, the spacers are post 25 or stiles. A bottom end 27 of each post extends slightly beneath the bottom plate 15 so as to form legs. The legs 27 bear on a floor surface 29. Each post 25 is coupled to each plate 15, 17, 19. In the preferred embodiment, each plate has two sides 30 and two ends 32. The posts are coupled to the sides of each plate, with two posts being coupled to a side. The apparatus has four posts 25. A bottom end portion 31 of each post 25 is coupled to the bottom plate 15, a top end portion 33 of each post is coupled to the top plate 19, and an intermediate portion 35 of each post is coupled to the middle plate 17. The posts 25 are coupled to the edges of the plates using an adhesive or fasteners (such as screws). In the preferred embodiment, the posts are notched with a groove, which groove receives an edge portion of the respective plate.

The apparatus 11 can be made of a variety of materials. For example, the apparatus can be made of wood, which is stained and finished in a furniture-like manner. The apparatus could also be made of plastic, metal or other materials.

To use the apparatus 11, the apparatus is set onto a floor surface 29 with its bottom plate 15 underneath the middle and top plates 17, 19. The plates are thus located in a horizontal orientation. A rolled plan 13 is inserted into a set of openings 23. More specifically, referring to FIG. 2, the rolled plan 13 has a first end 41 and a second end 43. The first end 41 is inserted into an opening (such as opening 23A) in a top plate 19. The rolled plan 13 is then oriented in a vertical direction and the first end 41 is dropped down to the middle plate 17. The first end 41 is inserted into the middle plate opening (23B) that is located directly underneath the top plate opening that receives the rolled plan. Then, the rolled plan is dropped so that the first end 41 bears on the bottom plate 15. The second end 43 of the rolled plan is at the top and extends some distance above the top plate (the actual distance depends on the size of the print media used).

To remove the rolled plan from the apparatus, the plan 13 is simply picked up by its top end 43 and pulled out of the openings 23.

The present invention provides a storage location for rolled print media, wherein the rolls are stored neatly and in an organized manner. Because the rolls are constrained by the openings, they need not be bound with a rubber band. When a roll is inserted into a set of openings, the roll may unfurl, wherein the roll expands to the inside diameter of the openings.

Figure 2:
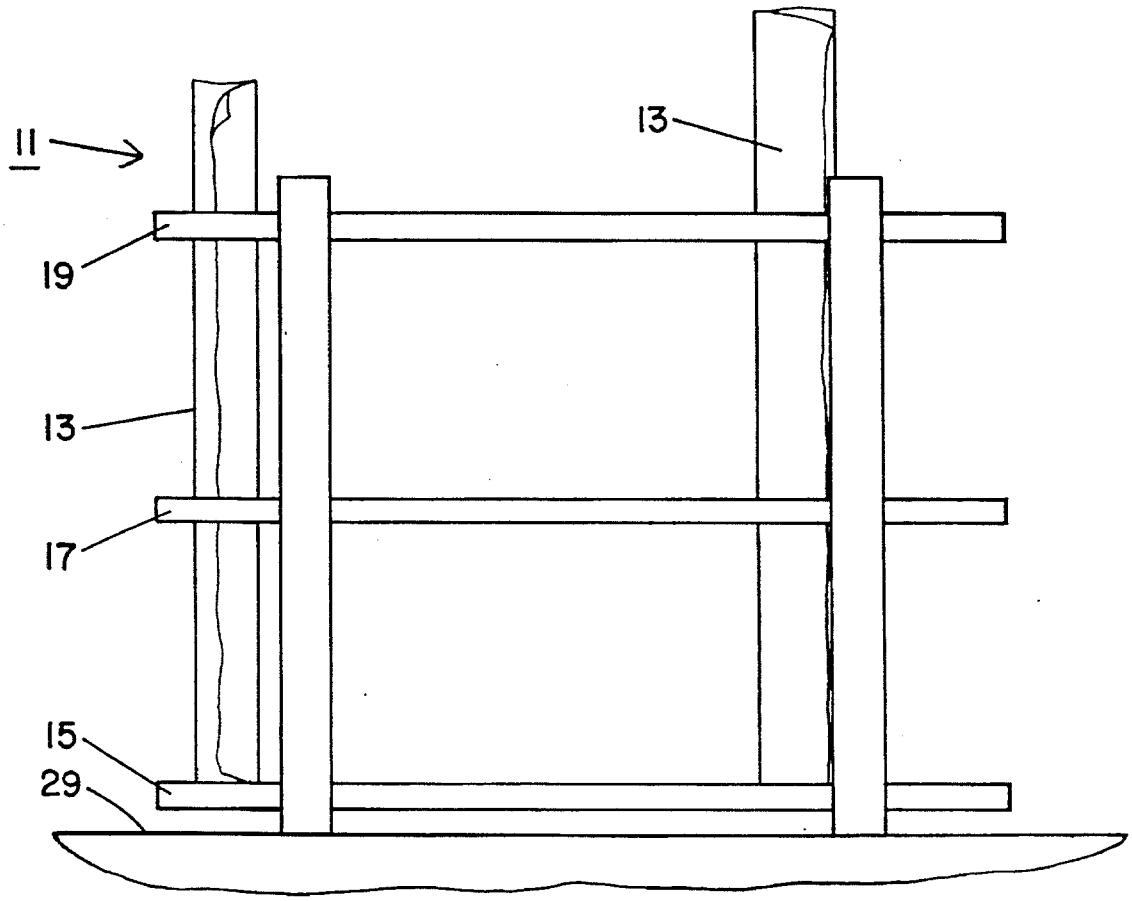
FIG. 2 is an elevational view of the apparatus of FIG. 1.

Rolled plans can be heavy. Storing the rolled plans in a vertical orientation as shown in FIG. 2 could produce a turning moment that acts on the apparatus, thereby causing the apparatus 11 and the plans 13 to turn over. This is especially true if the top ends of the plans extend above the top plate for a substantial distance.

Several aspects of the invention prevent the apparatus 11 from turning over. First, the bottom plate 15 is solid and acts as a counterweight that, because of its low placement and large mass, provide increased stability to the apparatus. For example, the bottom plate 15 can be made of heavy plywood. Having a heavy bottom plate serves to anchor the apparatus and prevents the apparatus and its plans from turning over.

Second, the top and bottom openings in a set of openings 23 are aligned with one another. This causes the rolled plan located in the set of openings to stand in a vertical orientation. Because the plan is vertical, most, if not all, of its weight bears on its bottom end 41 and thus on the bottom plate 15, thereby minimizing any turning moments created by the top end 43 of the plan. Thus, the apparatus 11 of the present invention provides a stable platform for holding heavy plans.

Also, the apparatus 11 can be made to look like a piece of furniture. The posts 25 and edges of the plates 15, 17, 19 can be shaped in a variety of manners so as to provide for a variety of furniture styles. Thus, plans can be stored in a home or office in an aesthetically pleasing holder.

The foregoing disclosure and the showings made in the drawings are merely illustrative of the principles of this invention and are not to be interpreted in a limiting sense.

I claim:

1. An apparatus for holding rolled print media, said print media being rolled into a cylindrical shape, comprising:

a) a bottom plate;

b) a middle plate;

c) a top plate;

d) said middle plate and said top plate each having plural openings therethrough, with each opening in said top plate being aligned with a respective opening in said middle plate, said bottom plate being solid in locations beneath said openings in said middle plate;

e) plural spacers fixedly coupling said bottom plate, said middle plate, and said top plate together in spaced apart relations, each of said spacers having a bottom end that extends below said bottom plate, wherein said apparatus bears on said spacer bottom ends, said spacers being separated from each other by a gap, each of said spacers coupling to said bottom, middle and top plates;

f) said rolled print media having two ends and being received by an aligned set of said openings in said middle and top plates, with one of said ends bearing on said bottom plate.

2. The apparatus of claim 1 wherein said bottom plate is solid.

3. The apparatus of claim 1 wherein said openings are circular.

4. The apparatus of claim 1 wherein said bottom, middle, and top plates are horizontally oriented.

5. The apparatus of claim 1 wherein each of said spacers comprises a post.

6. The apparatus of claim 1 wherein each of said spacers has a top end that extends above said top plate.

7. The apparatus of claim 1 wherein said bottom plate, said middle plate, and said top plate each have edges, said spacers being coupled to said edges of said bottom, middle, and top plates.

8. The apparatus of claim 7 wherein each of said spacers has notches, with said notches receiving said edges of said bottom, middle, and top plates.

* * * * *